United States Patent [19]

Harris

[11] Patent Number: 4,884,106

[45] Date of Patent: Nov. 28, 1989

[54] MULTI-IMAGE REPRODUCTION APPARATUS

[75] Inventor: Calvin E. Harris, Fairport, N.Y.

[73] Assignee: Eastman Kodak Company, Rochester, N.Y.

[21] Appl. No.: 239,885

[22] Filed: Sep. 2, 1988

[51] Int. Cl.[4] ..... G03G 15/01

[52] U.S. Cl. ..... 355/212; 355/327

[58] Field of Search ..... 355/229, 69, 35, 38, 355/327, 212

[56] References Cited

U.S. PATENT DOCUMENTS 4,025,186 5/1977 Hunt Jr..et al. ..... 355/212
4,080,061 3/1978 von Stein et al. ..... 355/38
4,082,443 4/1978 Draugelis et al. ..... 355/69 X
4,477,176 10/1984 Russel ..... 355/271 X
4,556,311 12/1985 Tagoku .
4,569,584 2/1986 St. John et al. ..... 355/327 X
4,705,386 11/1987 Ogita et al. ..... 355/327

*Primary Examiner*—A. T. Grimley
*Assistant Examiner*—Barry J. Shapiro
*Attorney, Agent, or Firm*—Leonard W. Treash

[57] ABSTRACT

A multi-image reproduction apparatus, for example a multicolor electrophotographic apparatus exposes consecutive image areas on a web, develops them and transfers them in registry to the receiving surface. Exposure is accomplished by flash illumination triggered by sensing indicia on the web. To assure point-to-point registration at transfer an adjustable delay is inserted in the flash actuation circuit. The delay is adjustable for one image area independently of the delay of the other image areas.

6 Claims, 2 Drawing Sheets

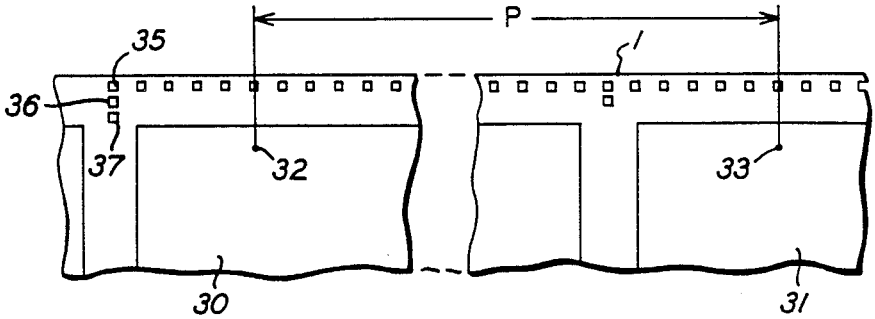
FIG. 2
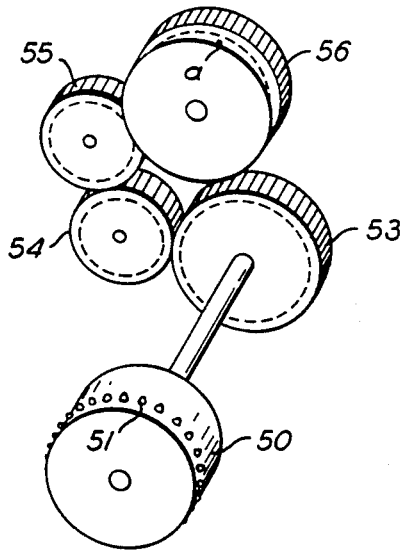
FIG. 3
FIG. 4
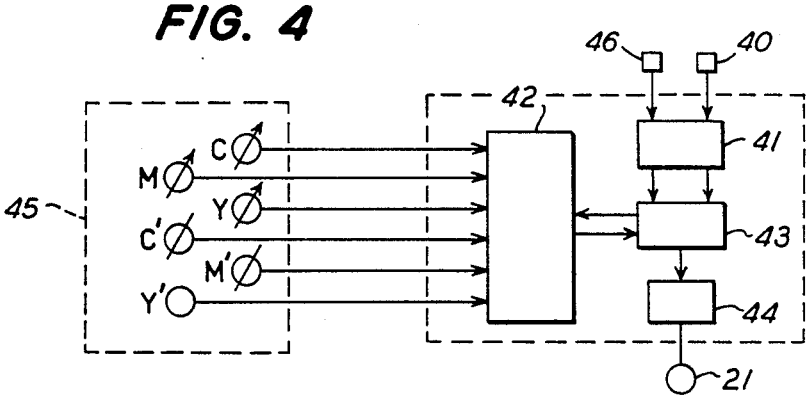

MULTI-IMAGE REPRODUCTION APPARATUS

CROSS-REFERENCE TO RELATED APPLICATIONS

This application is related to copending U.S. patent application Ser. No. 239,882, filed Sept. 2, 1988, in the names of Brian J. Joseph et al., titled REPRODUCTION APPARATUS HAVING SPROCKET-DRIVEN TRANSFER DRUM.

TECHNICAL FIELD

This invention relates to multi-image reproduction apparatus, for example, color reproduction apparatus in which a plurality of images are exposed and developed on an endless belt and are transferred in registration to form a composite image, for example, a multicolor image.

BACKGROUND ART

U.S. Pat. No. 4,477,176 granted Oct. 16, 1984 to M. J. Russel shows a color reproduction apparatus utilizing an electrophotosensitive web which is driven through an endless path. The web is uniformly charged and exposed to a series of color separation light images of an original to create latent electrostatic images. The images are developed with toners of different color to create visible color images and are transferred in registry to a receiving surface to form a multicolor image. The images are exposed by flash. Similar to monocolor apparatus using flash exposure, the flash is triggered by physical or optical sensing of a perforation (herein sometimes called "perf") associated with the image area to be exposed.

The quality of the multicolor image formed at the transfer station is dependent on several factors, one of which is the accuracy of the timing of the flash exposure. More specifically, if one exposure is early or late compared to the others by even an extremely small amount, this will show up in a slight difference in the location of the two images on the resulting multicolor reproduction. This misregistration shows up as both a loss of image sharpness and a change in hue of colors intended to be formed by combining toners. The structure shown in the Russel patent gives good results in most applications. However, accuracy in forming perforations in webs when such webs are manufactured in quantity is not adequate for the highest quality color production. Put another way, perforations formed in the edges of webs within tolerances acceptable for the highest quality camera and projector work can still be off enough to be noticeable when trying to do high quality color reproductions on this prior apparatus.

DISCLOSURE OF THE INVENTION

It is an object of the invention to provide an apparatus generally of the type described but in which highest quality registration can be obtained despite slight inaccuracies in the location of perfs or other timing indicia.

This and other objects are accomplished by a flash exposure means responsive to such indicia as described but which exposure means includes an actuating means having a delay means for delaying the actuation of the flash exposure by a predetermined time after sensing the indicia. The exposure means further includes means for adjusting the predetermined time for actuation of one image independent of any delay associated with other images to be combined at the transfer station.

According to a preferred embodiment, the web has a plurality of image areas with one perforation associated with each area and the means for adjusting the predetermined delay time includes means for adjusting said time independently for each perforation of the web.

With this structure a person installing a new web in the apparatus runs color reproductions using an appropriate color original, examines the originals for color registration and makes the appropriate adjustments in the delay time for the appropriate flashes to give the highest quality registration.

BRIEF DESCRIPTION OF THE DRAWINGS

FIG. 2 is a top view of an edge of an endless web usable in the apparatus shown in FIG. 1.

FIG. 3 is a perspective view of a drive train of a transfer apparatus shown as part of the apparatus in FIG. 1.

FIG. 4 is a schematic circuit diagram of the flash actuation circuitry for the apparatus shown in FIG. 1.

BEST MODE OF CARRYING OUT THE INVENTION

Figure 1:
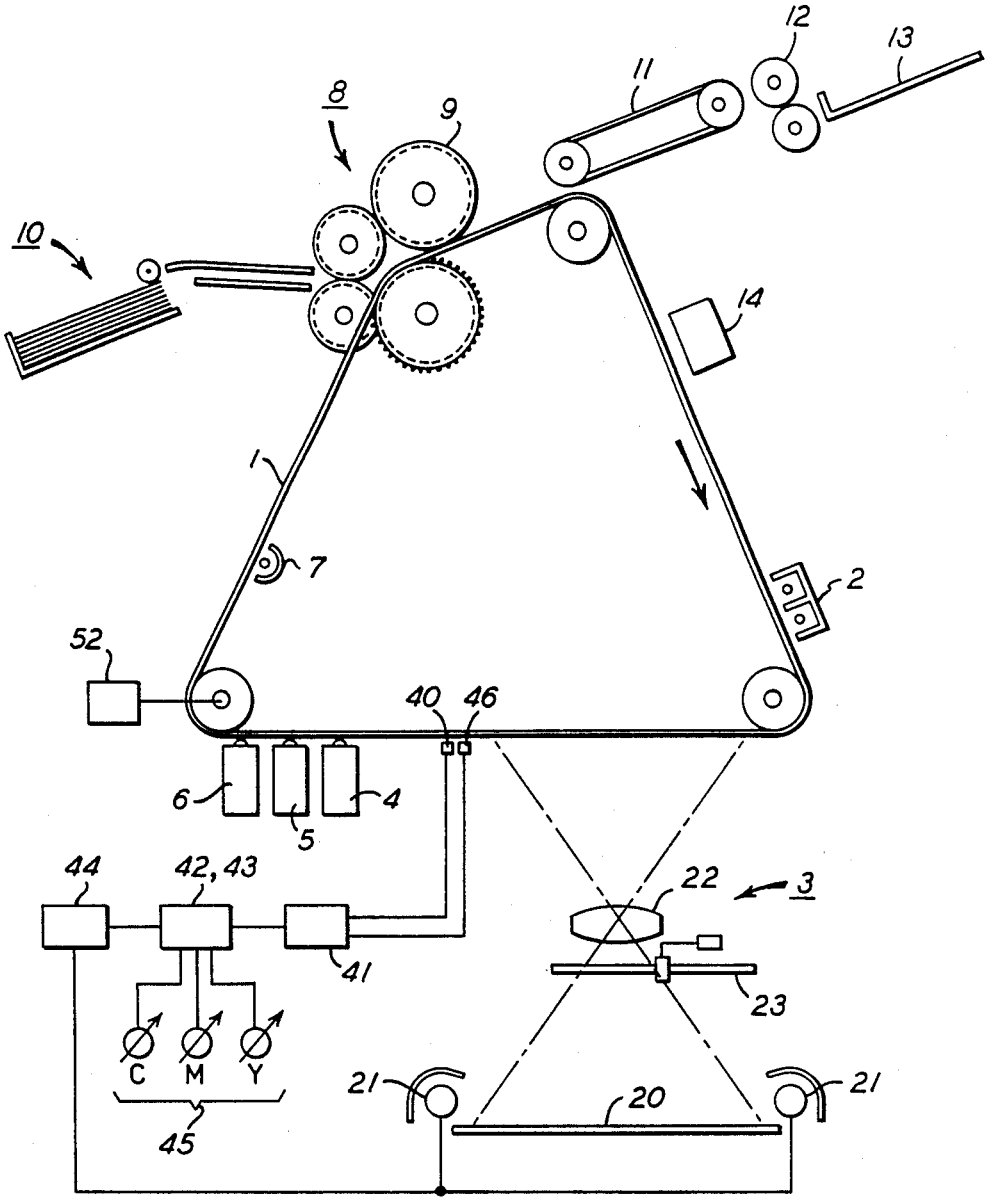
FIG. 1 is a schematic side view of a color electrophotographic apparatus constructed according to the invention.

According to FIG. 1 an electrophotosensitive web 1 is trained about a series of rollers to move through an endless path. Although the construction of the web can take various forms, conventionally it contains one or more photoconductive layers, a conductive layer and a suitable support.

The web is driven by a motor 52 and transported through operative relation with a series of stations to form multicolor reproductions on a receiving sheet. More specifically, the web is uniformly charged at a charging station 2, consecutive image areas (discussed in more detail below) are exposed to color separation images of an original at an exposure station 3 to form electrostatic latent images representative of the color separations, and the images are toned by appropriate colored toners at toning stations 4, 5 and 6 as is well known in the art.

Some of the forces holding the toner to the web 1 are eliminated by an erase lamp 7. The toner images then proceed to a transfer device 8 where they are transferred in registry to a receiving surface to form a multicolor image. More specifically, a receiving sheet is fed from a receiving sheet supply 10 to the transfer device 8 where the sheet is held on the periphery of a transfer drum 9. The transfer drum 9 is rotated at a speed bringing a receiving surface of the receiving sheet into repeated transfer relation with the toner images to transfer consecutive toner images in registry to the receiving surface of the receiving sheet. After the desired number of toner images have been transferred to the receiving surface the receiving sheet is separated from or no longer held by the transfer drum 9 and follows the web 1 until picked off by a receiving sheet transport mechanism 11 which transports it to a roller fuser 12 and hence to an output hopper 13. The web 1 is then cleaned at a cleaning station 14 for reuse. This general process as described is well known in the art and utilized by apparatus available commercially.

One of the critical aspects in forming multicolor reproductions of color originals using this apparatus is the preciseness of the registration of the toner images on the receiving surface. With the apparatus shown in FIG. 1 this registration is dependent primarily upon two stations, the exposure station and the transfer station. A given point on the receiving surface, as it is rotated by transfer drum 9 into transfer relation with the toner images, must receive toner from the same points in the consecutive images. If these points in consecutive images are off by even as much as .001 inches, the resulting multicolor image will appear less sharp, and in instances where a color is obtained by combining two or more toners at the same point, there will be a noticeable change in hue.

The exposure station is similar to that shown in U.S. Pat. No. 4,477,176 Russel. A color original 20 is illuminated at an exposure position by flash lamps 21. A color separation of the original is projected by a lens 22 onto the charged web 1. Color separation is provided by a filter wheel 23, as is known in the art.

Referring to FIG. 2 the web 1 is divided into discrete image areas 30, which are not necessarily physically defined. Although an individual color separation image need not be placed at a specific place in any image area 30, it is important that the pitch of the latent images be consistent with the pitch of the rotating receiving surface associated with transfer drum 9. For example, if a point in the original is imaged on consecutive image areas 30 and 31 as points 32 and 33, toner applied at those two points at the toner stations must be transferred to the same point on the receiving surface associated with transfer drum 9. The distance between the points 32 and 33 on the web 1 is the pitch P of the two images.

U.S. Pat. Nos. 3,914,047 and 4,025,186 both to Hunt, et al. are representative of a number of references which show timing flash exposure using timing marks for perforations on a web. Somewhat similar to those prior systems, web 1 as shown in FIG. 2 contains sprocket perforations 35 and flash perforations 36, and a single master perforation 37. A flash perf sensor 40 (FIG. 1) senses the flash perforations and a master perf sensor 46 senses the master perforation. The sprocket perforations may also be sensed. In general, the information derived from sensing the flash and master perforations is fed into appropriate circuitry which combines that information with its own timing circuitry and actuates the flash lamps 21 at the appropriate time to create the electrostatic latent image at the desired place in the image areas. Using this information the apparatus will also control other functions of the apparatus, including actuation of the toner stations 4, 5 and 6, feeding of the receiving sheet from receiving sheet supply 10, separation of the receiving sheet from the transfer drum, and the like.

Referring to FIG. 4 the circuitry associated with flashing the lamps 21 in response to sensing flash and master perforations is shown. Sensors 40 and 46 can be optical sensors for sensing the leading or trailing edge of a perforation, mechanical sensors as shown in the Hunt, et al. patents referred to above or any other suitable sensor for sensing indicia on a web. The sensor is actuated by the perforation, preferably an edge of the perforation, passing a given point thereby creating a signal which is amplified and processed by a signal conditioning amplifier 41 and fed to microprocessor using interrupt and multiplexing logic 43. Microprocessor 43 then controls actuation of flash lamps 21 through a flash illumination power supply 44. A delay is built into the system by connecting a multiplexing and delay timing circuit 42 to microprocessor 43.

In a perfect system, a fixed time after the sensing of each flash perforation, the flash lamps 21 are illuminated to create an electrostatic latent image in one of the image areas. This system is accurate enough for monocolor reproduction where slight variations in the location of the image on the final transfer surface are not noticeable to the human eye. However, in color systems in which consecutive images are to be placed in registry on the transfer surface, much greater accuracy is required for highest quality work. With ordinary film manufacturing processes, adequate for most photographic purposes, placement of the flash perforations is not accurate enough to give the highest quality color reproduction.

This problem has been solved in the apparatus shown in FIG. 1 by permitting the service person to adjust the delay between the sensing of the flash perforations and actuation of the flash lamps 21 separately for each image area on the web 1. This adjustment may be accomplished by a mechanical mechanism, knobs, set screws or the like which control the settings on real time delay adjusting potentiometers 45 in FIGS. 1 and 4. In turn, timing circuit 42 is adjustable by the potentiometers 45. In essence, a flash perforation is sensed by sensor 40 and the flash lamp 21 is actuated after a delay controlled by circuit 42 as adjusted for each flash perforation by potentiometers 45. In order to relate the potentiometers to a particular frame and thereby to a particular color, input from master perf sensor 46 is also fed to microprocessor 43. This input permits the logic and control circuitry to maintain each frame dedicated to a particular potentiometer for adjustment.

In doing color reproduction work of this type, using three colors, the toners are generally of the cyan, magenta and yellow color and are applied to electrostatic images formed through red, green and blue filters respectively.

Referring to FIG. 4 and assuming filter wheel 23 to have red, green and blue filters to control the projection of comparable separation images on the web 1, and assuming that the web 1 is of a length to accommodate six image areas, six separate adjustment devices are provided. As shown in FIG. 4, they are labeled C, M, Y, C', M' and Y'.

In operation, a service person replaces an old web with a new web in the apparatus shown in FIG. 1. Using a color test target, reproductions are made with the adjustment means 45 at a particular value, for example, each flash may be set to occur, say, 200 milliseconds after sensing each flash perforation.

The resulting reproductions are examined. This examination may include use of appropriate magnifiers to determine the registration of the images produced. If one or more of the color components making up the final multicolor image appears to be separated from the other components, the service person adjusts the appropriate set screw in adjustment means 45. For example, if a color reproduction made using the first three image areas following the master perforation shows the cyan-colored image and the yellow colored image in good registration but the magenta image slightly ahead of the other two images, the set screw noted as M in adjustment means 45 is adjusted to lengthen the time between sensing of the appropriate flash perforation and the flash for the green color separation exposure.

The second series of set screws C', M' and Y' can also be adjusted accordingly using a second color reproduction made with the fourth, fifth and sixth image areas.

In theory, it is not necessary that a specific color be associated with a specific image area. The set screws could be numbered 1 through 6, one for each image frame (denoting the image frames, in order, after the master perforation) since they are basically adjusted only for variations in the location of the flash perforations. However, it is easier for the service person to recognize which set screws should be adjusted if the set screws and, therefore, the image areas are dedicated to a particular color. More complicated systems are possible. For example, a four color system, cyan, magenta, yellow and black, may also use a six image area web. One approach to proper adjustment in this instance, is to operate the apparatus as a three color apparatus during the set up. Once the set screws are fine tuned for each flash perforation, the apparatus is indifferent to what color images and toners are used with any particular image area. Obviously, other schemes could be used for setting the potentiometers 45.

The flash perforations make programming the microprocessor easier. However, the sprocket perforations alone could be used with the master perforation to accomplish the result desired. Essentially, microprocessor 42 would count sprocket perforations with respect to the master perforation, utilizing one of the sprocket perforations in each image area essentially as a flash perforation. Also, other indicia may be used that can be sensed by the apparatus, for example, optically sensible marks, electrically sensible variations in conductivity or magnetically sensible magnetic indicia.

Although this system is described using a timing delay circuit for measuring the delay imposed on the flash actuation circuit, the approach can also work from an encoder (not shown) which monitors the angular position of one of the rollers. In this alternative, the delay is in terms of encoder pulses and is not strictly a time but is a length of web after the flash perf is sensed.

Assuming that the toned color images leaving toner stations 4, 5 and 6 have the proper pitch, the transfer drum 9 must still be rotated properly to assure that each point on the receiving surface receives comparable points from each toner image. U.S. Pat. No. 4,724,458 to Roy et al shows a mechanism in which the transfer drum 9 is driven by a sprocket which engages sprocket perforations in an electrophotosensitive web. The sprocket drives the transfer drum through a gear train including a drum gear coaxial with the transfer drum and a sprocket gear coaxial with the sprocket and two intermediate gears. However, it was found that great preciseness was required in the gearing to assure that the transfer drum brought the same point on the receiving surface back to the comparable points on the respective toner images. This need for preciseness has been cured in this apparatus by careful choice of sprocket and gearing sizes. Referring to FIG. 3, a sprocket 50 includes teeth 51 which engage sprocket perforations 35 in web 1. Sprocket 50 is driven by web 1 maintaining contact between teeth 51 and the trailing edge of sprocket perforations 35. Sprocket 50 also drives transfer drum 9 through a gear train that includes a sprocket gear 53 coaxial with and driven with and by sprocket 50, two intermediate gears 54 and 55, and a drum gear 56 coaxial with and driven with drum 9.

Sprocket 50 and gears 53, 54, 55 and 56 are sized to assure that the same teeth in each component are supplying the driving force for rotating transfer drum 9 for comparable points in successive images. Preferably, sprocket 50 has a circumference effectively equal to the pitch P of the images as described with respect to FIG. 2. Similarly, each of gears 54 and 55 have circumferences which when divided into the circumference of sprocket 50 give an integer. For example, if the pitch of the image is 51 sprocket perforations over, say 300 millimeters, sprocket 50 should have 51 teeth and have an effective circumference of 300 millimeters. Gear 53 would also have the same 300 millimeter circumference and can have any number of teeth, say 66 teeth. Intermediate gears 54 and 55 can be made one-half the size of gear 53, having an effective circumference of 150 millimeters each and 33 teeth. Gear 56 must have the same circumference as transfer drum 9 which of necessity is equal to the pitch of the images and, therefore, gear 56 is 300 millimeters in circumference and has 66 teeth. With this transfer device constructed accordingly, each point on the receiving surface will be driven by the same teeth throughout the gear train and the sprocket for each image being transferred. Thus, if there is any imprecision in any tooth in any of the gears, that imprecision will be repeated at the same place in the transfer process for each image. Although a slight distortion in the length of the document may occur at that point, there will be no distortion in image sharpness or hue as a result of the respective images not coinciding. The slight distortion in length of an otherwise high quality color image is not noticeable.

Thus, the resulting color reproduction can be of very high quality without the expense of extremely precise drive gearing between the sprocket and the transfer drum.

The web 1 can drive the sprocket 50 as shown with the teeth 51 engaging the trailing edge of the sprocket perforations 35. Alternatively, the web 1 can be driven by the sprocket 50 with the teeth 51 engaging the leading edges of the perforations 35.

The apparatus shown in FIG. 1 need not be of the type which a transfer sheet is secured to the surface of the transfer drum 9. Other systems are known in which three or four consecutive color images are transferred directly to the surface of drum 9 to form a multicolor image on the surface which is then retransferred to a transfer sheet at a position either remote from the transfer drum-web nip or at the nip itself. The registration features disclosed herein are usable with such systems. Similarly, the transfer drum may be of a size large enough to hold two multicolor images on its surface or on the surface of two receiving sheets; see, for example, U.S. Pat. No. 4,712,906 to Bothner et al. These registration systems could be used with such apparatus, the pitch of the images then being consecutive pairs of images rather than consecutive images.

While the invention has been described in connection with a preferred embodiment thereof, it will be understood that variations and modifications can be effected within the spirit and scope of the invention as described hereinabove and as defined in the appended claims.

I claim:

1. A reproduction apparatus of the type having means for supporting and moving a light sensitive web through an endless path, means for exposing said web to a series of light images to create latent images thereon, means for developing said images to create visible images defined by the latent images and means for transferring the visible images in registry to a recieving surface to form a composite image, characterized in that the exposing means includes:

exposure means for illuminating an original, means for sensing indicia on the web, means for actuating said exposure means in response to sensing said indicia, said actuating means including delay means for delaying the actuation of said exposure means, and means for adjusting said delay for actuation of one image independently of any delay associated with other images intended to define the same ultimate composite image.

2. A color reproduction apparatus of the type having means for supporting and moving an electrophotosensitive web through an endless path, means for uniformly charging said web, means for exposing said web to a series of color separation light images of an original to create latent electrostatic images thereon, means for developing said images with toners of different color to create visible color images defined by the latent images and means for transferring the visible color images in registry to a receiving surface to form a multicolor image, characterized in that the exposing means includes:

flash exposure means for illuminating the original, means for sensing indicia on the web, means for actuating said flash exposure means in response to sensing said indicia, said actuating means including delay means for delaying the actuation of said flash exposure means by a predetermined delay after sensing said indicia, and means for adjusting said predetermined delay for actuation of one image independently of any delay associated with other images intended to define the same ultimate multicolor image.

3. The apparatus according to claim 2 wherein said apparatus includes means for applying at least three toners of different color to different ones of a series of at least three electrostatic images and said exposure means includes means for interposing at least three different color filters in an optical path between an original and the web to create at least three electrostatic images defining color seperations of the original and said delay means includes means for varying the predetermined delay for each different color separation independently of the delays for the other color separations.

4. The apparatus according to claim 2 wherein said delay means includes means for delaying said actuation by a predetermined time and said adjusting means includes means for adjusting said predetermined time.

5. A color reproduction apparatus comprising:

means for supporting and moving an electrophotosensitive web through an endless path said web having intended image areas and at least one perforation for each image area, each perforation being located in a predetermined position with respect to its respective image area, means for uniformly charging said web, means for exposing said web to a series of color separation light images of an original to create latent electrostatic images thereon representative of said color separation images, each such electrostatic image being located in a separate image area, said exposing means including flash exposure means for illuminating the original, means for sensing the arrival of a perforation at a predetermined position along said endless path, means for actuating said flash exposure means in response to sensing a perforation associated with the image area to be exposed, said actuating means including delay means for delaying the actuation of said flash exposure means by a predetermined time after sensing said perforation, and means for adjusting said predetermined time for actuation independently for each perforation of said web, means for developing said images with toners of different color to create visible color images defined by the latent images, and means for transferring the visible color images in registry to a recieving surface to form a multicolor image, the accuracy of the registration of the color images being dependant upon the accuracy of the relative locations of the exposures with respect to the image areas.

6. Apparatus according to claim 5 wherein said apparatus includes means for sensing the arrival of a master perforation at a predetermined position along said endless path and logic means for controlling actuation of said flash exposure which logic means is responsive to said sensing of a master perforation to control application of a particular delay time to actuation of said flash exposure for each perforation of said web.

* * * * *